United States Patent [19]

Harrop

[11] 4,180,267

[45] Dec. 25, 1979

[54] BALL ROLLOVER SWITCH ASSEMBLY

[75] Inventor: Geoffrey A. J. Harrop, Saratoga, Calif.

[73] Assignee: Atari, Inc., Sunnyvale, Calif.

[21] Appl. No.: 868,672

[22] Filed: Jan. 11, 1978

[51] Int. Cl.[2] ..... A63B 71/00

[52] U.S. Cl. ..... 273/127 R; 273/118 A

[58] Field of Search ..... 273/127 R, 118 A, 119 A, 273/121 A, 121 D, 121 E, 122 A, 123 R, 123 A, 124 R, 124 A, 125 R, 125 A, 126 A; 200/61.11

[56] References Cited

U.S. PATENT DOCUMENTS

| | | | |
|---|---|---|---|
| 2,103,744 | 12/1937 | Dumble | 273/121 A |
| 2,253,796 | 8/1941 | Livingston | 273/118 A |
| 3,259,388 | 7/1966 | Durant | 273/126 A |

*Primary Examiner*—Richard C. Pinkham

*Assistant Examiner*—T. Brown

*Attorney, Agent, or Firm*—Townsend and Townsend

[57] ABSTRACT

A ball rollover switch assembly for use in an amusement game having a playfield. A microswitch is mounted below the playfield and carries an operating blade which extends below a slot formed in the playfield. A translucent actuator body is mounted on the free end of the blade and is formed with a nose which projects upwardly through the slot. The blade of the switch in its raised position holds the actuator body so that an upper portion of the nose projects above the playfield. A ball moving across the playfield rolls over the nose to depress the body and move the blade to a lowered position for actuating the switch. Light from a source below the playfield is transmitted through the body to create an illumination effect.

4 Claims, 3 Drawing Figures

BALL ROLLOVER SWITCH ASSEMBLY

BACKGROUND OF THE INVENTION

This invention in general relates to amusement games incorporating playfields, such as pinball games.

Previously pinball game designs have included various types of switches and devices which are actuated by balls rolling over the playfield. Among these devices are wire form rollovers, button rollovers and star rollovers. Wire form rollovers incorporate a wire mounted on the playfield above a track with the wire connected to operate a control switch responsive to a ball moving along the track. Switch actuators of this type are relatively simple and inexpensive but have no aesthetic appeal. Button rollovers are typically made of a plastics material and are mounted in the playfield to operate a switch responsive to movement of a ball. Although button rollovers can have an attractive appearance and can be backlighted they have a number of limitations such as the need for precise pressure adjustment, otherwise the ball may not properly operate the rollover and can hang up on the playfield. Star rollovers are of relatively large dimensions and typically are made with an attractive aesthetic appearance, but they also have limitations such as the susceptibility to sticking in normal use which can result from the buildup of cleaning wax and dirt. It would be desirable to provide a ball rollover switch assembly having the simplicity and low cost of wire form rollovers but at the same time having the aesthetic appearance features of the botton and star rollovers without the latter's drawbacks.

OBJECTS AND SUMMARY OF THE INVENTION

It is a general object of the invention to provide a new and improved ball rollover switch assembly for an amusement game of the pinball type.

Another object is to provide a ball rollover switch assembly of the type described which is relatively simple in design and operation, is inexpensive to manufacture and can be readily installed with a minimum of parts.

Another object is to provide a ball rollover switch assembly of the type described of a simple, trouble-free design which at the same time has an actuator body that can be backlighted to provide an attractive appearance.

The invention in summary includes a control switch mounted below the playfield and which carries an operating blade movable between raised and lowered positions. An actuator body mounted on the blade is formed with a nose which projects through a slot in the playfield with the upper rim of the nose being contacted by balls moving over the playfield to depress the body and actuate the switch. The body is formed of a material transmissive to light so that light from a source below the playfield creates an attractive illumination effect.

The foregoing and additional objects and features of the invention will appear from the following specification in which the several embodiments of the invention have been set forth in detail in conjunction with the accompanying drawings.

DESCRIPTION OF THE PREFERRED EMBODIMENTS

Figure 1:
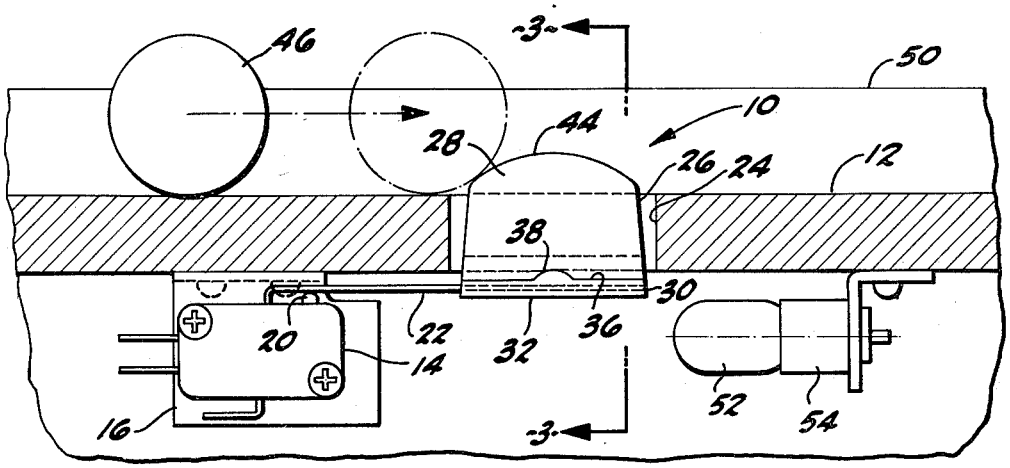
FIG. 1 is a vertical section view of the switch assembly of the invention with the actuator body illustrated in its raised position.

In the drawings ball rollover switch assembly 10 of the invention is mounted below the playfield 12 of a pinball amusement game. Only a portion of the playfield is illustrated and the playfield would incorporate other game components, such as a ball shooter, flippers, pop switches and bumper switches, lights, score displays and a control circuit, not shown.

Switch assembly 10 includes a microswitch 14 mounted on bracket 16 below the playfield. Terminals 18 on the microswitch are adapted to be connected by suitable leads, not shown, to the control circuit which can be programmed as desired to advance the score, operate certain lights or perform other control functions when a ball actuates the switch assembly. Microswitch 14 is operated by a button 20 which in turn is actuated by an operating member or elongate flat blade 22 which projects over the button. The microswitch is mounted so that the distal end of the blade extends in register below an elongate slot 24 formed in the playfield. The blade is biased by spring memory toward its normally raised first position shown in FIG. 1 and is movable through an arc toward the lowered second position shown in FIG. 2. The microswitch can be wired so that it is either in a normally open or normally closed state when the blade is raised, depending upon the desired control circuit design.

An actuator body 26 is mounted on the distal end of the blade and is formed with an upright nose 28 which projects into the slot. The body is secured to blade 22 by friction in a channel 30 formed along the base 32 of the actuator body. The cross-sectional size and shape of channel 30 is generally commensurate with the size and shape of the blade with the tolerances providing an interference fit such that the walls of the base elastically spread apart as the blade is inserted in the channel. A groove 34 is formed along the sides of the channel within the body to permit the walls to flex.

Figure 3:
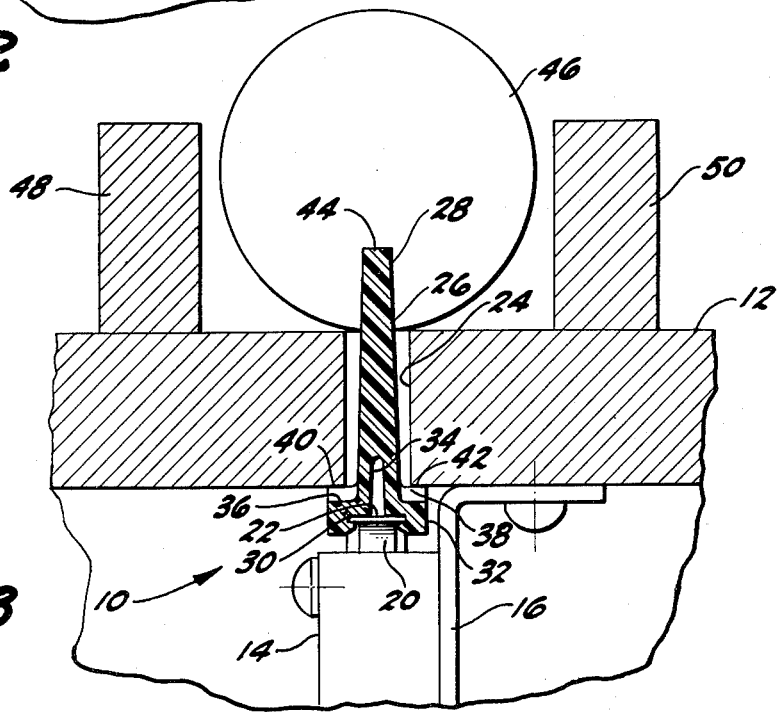
FIG. 3 is a cross-sectional view to an enlarged scale taken along the line 3—3 of FIG. 1.

The base 32 of the actuator body is formed along its length with shoulders 36, 38 which project laterally across the width of the slot. The shoulders thereby form a shield which prevents harsh light from sources below the playfield being observed by those playing the game. A pair of protuberances or bosses 40, 42 are formed above the shoulders on opposite sides of the body. The bosses project laterally in register with the edges of slot 24 so as to contact these edges and stop upward movement of the actuator body at a predetermined position. Preferably the body is stopped at a position where substantially only the arcuate, upwardly convex rim 44 of the nose projects above the playfield upper surface, as illustrated in FIGS. 1 and 3.

Figure 2:
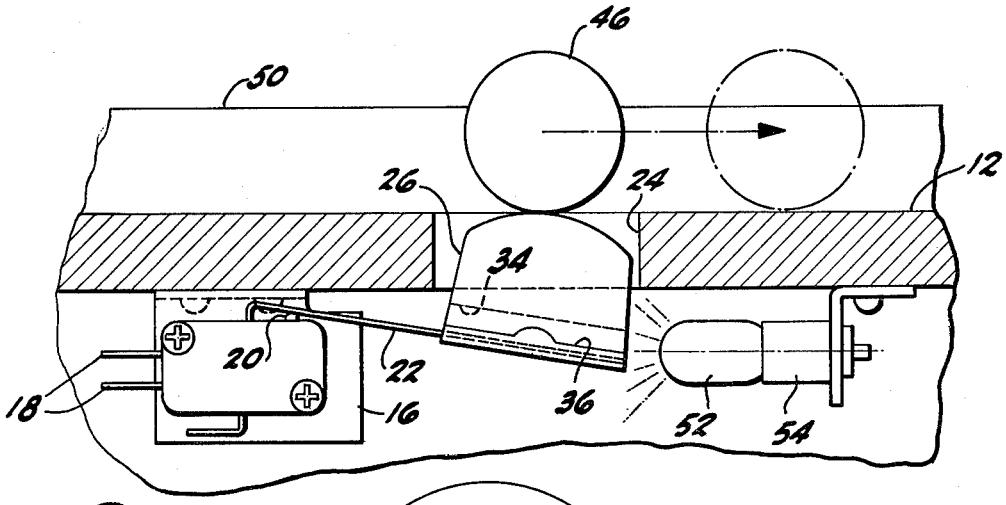
FIG. 2 is a view similar to FIG. 1 illustrating the actuator body in its lowered position.

In its raised position the upper rim 44 of the actuator body provides a camming surface against which a ball 46 rolling over the playfield acts to depress the body toward its lowered position as shown in FIG. 2. The ball is guided along a path over the actuator body by a track formed by a pair of upstanding walls 48, 50. The balls could also be guided along the path by suitable wireforms, not shown, provided in place of the walls. It is a feature of the invention that the upper rim 44 is curved at opposite ends of the body so that a ball rolling in either direction along the track actuates the switch. This provides flexibility in mounting the switch assembly in different positions and combinations on the playfield.

Actuator body 26 is formed of a suitable material which is transmissive to light, such as an acrylic synthetic polymer. Preferably the material of the body has a color such as red so that light from a source below the playfield is transmitted through the body and creates a pleasing aesthetic appearance when viewed from above. The upper surface of the rim 44 if formed with a matt finish so that light transmitted through the rim is diffused for additional aesthetic appeal.

An incandescent bulb 52 mounted on a socket 54 below the playfield and adjacent the slot provides the light source for illuminating the actuator body. The bulb is connected through suitable leads, not shown, with the control circuit. The control circuit can be programmed to activate the bulb in various ways, depending upon the results desired. For example, the bulb could be activated continuously so that the actuator body is continuously illuminated, or the bulb could be activated when microswitch 14 is actuated to provide a visual scoring indication.

The use and operation of the invention is as follows. Microswitch blade 26 is initially inserted in a friction fit within the channel 30 of actuator body 26. Separate fasteners for holding the body to the blade are not required, although they could be provided if desired. Microswitch 14 is mounted by bracket 16 below the playfield with the actuator body projecting through slot 24. A ball rolling along the track of the playfield in the manner shown in FIG. 1 cams against the rim of nose 28 to move the body and thereby the blade downwardly to the lowered position of FIG. 2. The blade in turn actuates the microswitch for operating the control circuit. The control circuit advances the score display and can, if programmed to do so, activate bulb 52. Light from the bulb is transmitted through the body and is diffused by the nose rim to create an attractive display from above the playfield. As the ball moves away from the playfield slot the spring memory of the blade returns the actuator body to its raised position to await another ball.

It is apparent from the foregoing that there has been provided herein a new and improved ball rollover switch assembly. Components of the assembly are relatively inexpensive to manufacture. For example, the actuator body can be made by conventional injection molding. The actuator body is easily assembled without the requirement for separate fasteners on the blade of the microswitch. When installed the actuator body presents a pleasing aesthetic appearance, especially when backlighted. The switch can be operated by a ball rolling along the track in either direction. The simplicity of the design is such that precise pressure adjustment is not required. Thus ball hangup is avoided and the switch is not susceptible to sticking so that operating life is long.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A ball rollover switch assembly for use in an amusement game having a playfield provided with slot means therein comprising the combination of: a control switch having an operating member which is movable between first and second positions for controlling a circuit, said control switch adapted to be mounted in an operative location below the playfield and near said slot means, an elongated ball-operated actuator body mounted on the operating member, said actuator body having an upright nose adapted to project into said slot menas formed in the playfield, at least a portion of the nose adapted to extend above the playfield when the operating member is in its first position and when said control switch is in said operative location, whereby balls moving over the playfield roll over the nose and depress the actuator body for moving the operating member toward its second position, said body being formed of a material which is transmissive to light, whereby light from a source below the playfield can transmit through the body for creating an aesthetic illumination effect, the actuator body having a base formed along its length, said base having shoulder means which projects laterally of the body across the slot means for substantially shielding the slot means from light below the playfield when said control switch is in said operative location.

2. A ball rollover switch assembly for use in an amusement game having means defining a playfield provided with slot means therein comprising the combination of a control switch having an operating member which is movable between first and second positions for controlling a circuit, said control switch adapted to be mounted in an operative location below the playfield and near said slot means, an elongated ball-operated actuator body mounted on the operating member, said actuator body having an upright nose adapted to project into said slot means formed in the playfield, at least a portion of the nose adapted to extend above the playfield when the operating member is in its first position and when said control switch is in said operative location, whereby balls moving over the playfield roll over the nose and depress the actuator body for moving the operating member toward its second position, said body being formed of a material which is transmissive to light, whereby light from a source below the playfield can transmit through the body for creating an aesthetic illumination effect, said playfield defining means having a lower surface, said actuator body having a boss formed with at least one boss aligned with said lower surface near said slot means when said control switch is in said operative location, whereby the boss can engage said lower surface and stop the actuator body in a raised position when the operating member is in the first position so that a predetermined portion of the nose can project above the playfield.

3. A ball rollover switch assembly for use in an amusement game having a playfield, comprising the combination of a microswitch having a flat blade defining an operating member, said blade being movable between first and second positions for controlling a circuit, said microswitch adapted to be mounted in an operative location below the playfield and near said slot means, an elongated ball-operated actuator body having an enlarged base provided with a channel conforming generally in size and cross-sectional shape with the blade, said blade being mounted in a friction fit in the channel, said actuator body having an upright nose adapted to project into said slot means formed in the playfield, at least a portion of the nose adapted to extend above the playfield when the operating member is in its first position and when said control switch is in said operative location, whereby balls moving over the playfield roll over the nose and depress the actuator body for moving the operating member toward its second position, said body being formed of a material which is transmissive to light, whereby light from a source below the playfield can transmit through the body for creating an aesthetic illumination effect.

4. An amusement game having means defining a playfield over which balls are rolled, the playfield having a slot therein, the combination with said playfield defining means of a switch mounted below the playfield and having an operating blade which is movable between raised and lowered positions and projects across said slot, an actuator body having an enlarged base formed with a horizontally extending channel, said actuator body being mounted on the blade with the blade secured within the channel, said body having a vertically elongate nose which extends upwardly through the slot of the playfield, said nose having an arcuate, upwardly-convex rim which projects above the upper surface of the playfield when the blade is in its raised position, said rim forming a camming surface which is contacted by a ball moving across the playfield for depressing the actuator body and moving the blade toward its lowered position, said body being formed of a material transmissive to light, and light source means mounted below the playfield for directing light through the body to illuminate the nose portion as viewed from the above playfield.

* * * * *